United States Patent [19]

Biggs

[11] 4,194,771

[45] Mar. 25, 1980

[54] MAGNETIC DOOR STAY RETAINER

[76] Inventor: Ronald L. Biggs, 874 Lexington, Wichita, Kans. 67218

[21] Appl. No.: 906,086

[22] Filed: May 15, 1978

[51] Int. Cl.[2] ..... E05C 17/56

[52] U.S. Cl. ..... 292/251.5; 292/340

[58] Field of Search ..... 292/251.5, 138, 157, 292/33, 16, 74, 340; 70/276; 24/201 B, 73 MS

[56] References Cited

U.S. PATENT DOCUMENTS

| | | | |
|---|---|---|---|
| 2,497,697 | 2/1950 | Smith | 292/251.5 X |
| 2,719,050 | 9/1955 | Teetor | 292/251.5 |
| 2,983,538 | 5/1961 | Fletcher | 292/251.5 |
| 3,418,018 | 12/1968 | Marburger et al. | 292/251.5 |

FOREIGN PATENT DOCUMENTS

| | | | |
|---|---|---|---|
| 1164272 | 2/1964 | Fed. Rep. of Germany | 292/251.5 |
| 1319358 | 1/1963 | France | 292/251.5 |
| 693564 | 7/1953 | United Kingdom | 292/251.5 |
| 842884 | 7/1960 | United Kingdom | 292/251.5 |

*Primary Examiner*—William E. Lyddane

*Attorney, Agent, or Firm*—Robert E. Breidenthal

[57] ABSTRACT

A magnetic door stay retainer for retaining a swinging door in a closed position in a door frame. The retainer automatically holds the door in a closed position in a door frame when the door is closed. The retainer is adjustable in controlling the amount of force required to open a door when, for example, wind gusts tend to blow the door open.

9 Claims, 7 Drawing Figures

MAGNETIC DOOR STAY RETAINER

BACKGROUND OF THE INVENTION

This invention relates generally to a door retainer and more particularly, but not by way of limitation, to a magnetic door stay retainer for holding a one-way or two-way swinging door in a closed position in a door frame.

Heretofore there have been various types of magnetic catches and door latches as disclosed in U.S. Pat. No. 2,719,050 and U.S. Pat. No. 2,853,331 to Teetor, and U.S. Pat. No. 2,586,900 to Alderman. Also, there are prior art magnetic door stops and magnet touch latches described in U.S. Pat. No. 2,497,697 to Smith, U.S. Pat. No. 3,258,285 to Smith and U.S. Pat. No. 3,492,037 to Hutchinson.

While the above prior art patents disclose various types of magnetic devices for holding doors in a closed position, none of them disclose the structure and the advantages of the subject invention as described herein.

SUMMARY OF THE INVENTION

The subject invention retains a one-way and two-way swinging door in a closed position in a door frame. The retainer is adjustable so that various degrees of force must be applied to overcome the resistance of the retainer and open the door.

The retainer holds the door in a door frame in a closed position and prevents the loss of heat in the winter and airconditioning in the summer due to wind gusts opening the door.

The invention is simple in design, is concealed in the door and door frame, is adjustable for activating and de-activating the retainer in holding the door in a closed position, and is maintenance free.

The retainer can quickly be installed in new doors, doors that are already in operation, and may be used on various sizes, types, and designs of doors.

The magnetic door stay retainer includes a magnet mounted in a magnet housing. The housing is adapted for receipt in the door frame. A retainer bar groove is disposed in the magnet housing and adjacent the door when the door is in a closed position in the door frame. A metal retainer bar housing is adapted for receipt in the door and includes an elongated channel therein. A metal retainer bar is slidably mounted in the channel with a top portion of the bar dimensioned for receipt in the groove. When the swinging door is in a closed position in the door frame, the bar is indexed adjacent the groove in the magnet housing. The magnet urges the bar upwardly with the top portion of the bar received in the groove for retaining the door in a closed position in the door frame.

The advantages and object of the invention will become evident in the following detailed description when read in conjunction with the accompanying drawings which illustrate the preferred embodiments of the invention.

DETAILED DESCRIPTION OF THE DRAWINGS

Figure 1:
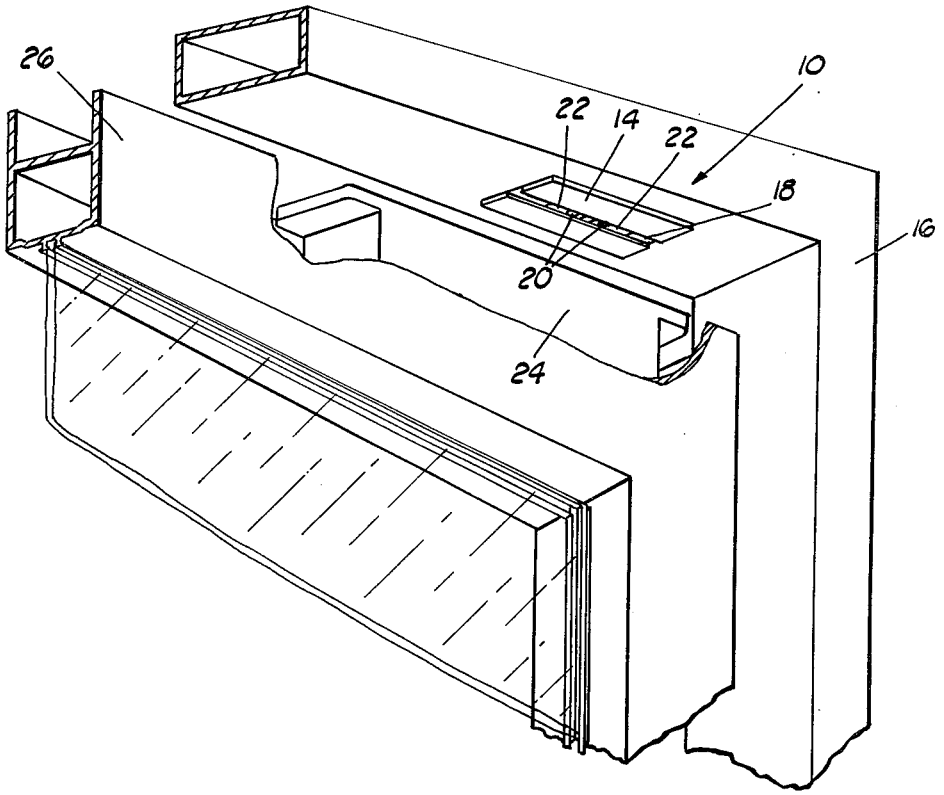
FIG. 1 is a perspective view of the magnetic door stay retainer mounted in a door frame and a door.

In FIG. 1 the magnetic door stay retainer is designated by general reference numeral 10. The retainer 10 includes a magnet 12 shown in FIG. 2 mounted in a magnet housing 14. The housing 14 is adapted for receipt in a door frame 16 and is attached thereto. The magnet housing 14 in this illustration is mounted in the top of the door frame 16 and includes an elongated groove 18 extending along the length of the housing 14 and parallel to the top of the door frame 16. In the groove 18 are a pair of adjustment screws 20 which are threaded into metal spacers 22. The spacers 22 are mounted adjacent the poles of the magnet 12. This structure can be seen more clearly in FIGS. 2 and 3.

Figure 2:
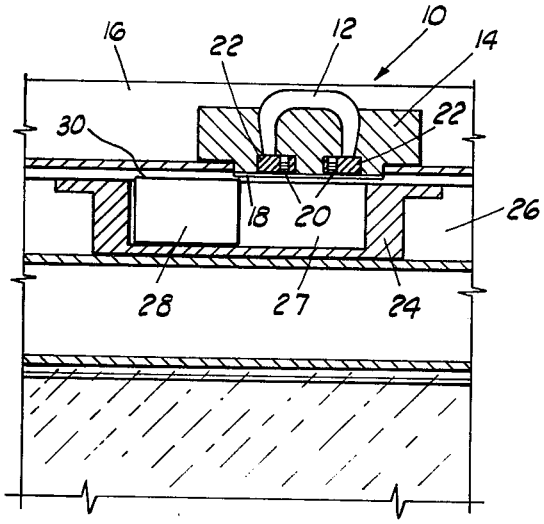
FIG. 2 is a side sectional view of the retainer in a de-activated position.
Figure 3:
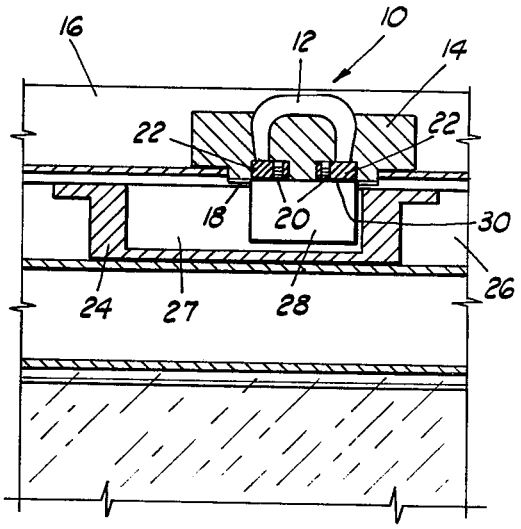
FIG. 3 is a side sectional view of the retainer in an activated position with the retainer bar engaged in the groove of the magnet housing.

The retainer 10 further includes a metal retainer bar housing 24 which is adapted for receipt in the top of a door 26 and attached thereto. The retainer bar housing 24 includes an elongated channel 27, which is shown in FIGS. 2 and 3 for receiving a metal retainer bar or armature 28. When the door 26 is in a closed position in the door frame 16, the elongated channel 27 is disposed adjacent to and parallel the groove 18 in the magnet housing 14.

In FIG. 1 the door frame 16 and door 26 are shown made of metal tubular construction. It should be appreciated that the door 16 and door frame 26 may be made of various types of materials. The retainer 10, while mounted in the top of the door 26 and door frame 16, will work equally well mounted in various other positions on the door 26 and door frame 16.

In FIG. 2 the retainer 10 is shown in a de-activated or "off" position. By this, the door 26 is not held in a closed position in the frame 16 since the bar 28 has been moved to the left in the channel 27 and is not indexed below the magnet 12 and therefore is not attracted upwardly into the groove 18.

In FIG. 3 the retainer 10 is shown in an activated or "on" position holding the door 26 in a closed position in the frame 16. The bar 28 includes a top portion 30 which is dimensioned for receipt in the groove or recess 18.

In operation, when the metal retainer bar 28 is moved to the right end of the channel 27 and the door 26 is closed in the door frame 16, placing the magnetic and armature units (hereinafter defined) in registry, whereupon the armature 28 is magnetically attracted to the magnet 12 in the housing 14. The bar 28 is urged upwardly and the top portion 30 is received inside the groove 18. The depth of the groove 18 for receiving the top portion 30 of the bar 28 is adjusted by the threaded screws 20 in the metal spacers 22. The metal spacers 22 are provided for ease in receiving the screws 20 rather than threading the screws 20 directly to the magnet 12. By threading the screws 20 upwardly into the spacers 22, the depth of the groove 18 is increased for receiving the top portion 30 of the bar 28. The greater amount of the top portion 30 of the bar 28 received in the groove 18 will accordingly increase the amount of force required to dis-engage the bar 28 from the groove 18 and open the door 26. By adjusting the screws 20 downwardly, the depth of the groove 18 is decreased, therefore a lesser amount of the top portion 30 of the bar 28 is received in the groove 18. In this case only a slight force is required to dis-engage the bar 28 from the groove 18 and open the door 26. As can be appreciated, depending on wind conditions due to inclement weather, the retainer 10 may be adjusted accordingly to hold the door 26 in place in the door frame 16 and prevent it from being opened by excessive wind force.

Not only do the screws 20 constitute means for adjusting the effective depth of the groove 18 insofar as depth of penetration by the bar or armature 28 is concerned, such screws 20 also constitute means for adjustably limiting the magnetic force between the magnet 12 and the armature 28 when the latter is in door retaining position. Such can also be viewed as a means for adjustably setting a lower limit on the reluctance of the magnetic circuit that includes the magnet 12 and the armature 28, it being noted that the attractive force between the magnet 12 and the armature 28 diminishes on an increase of the reluctance of such circuit. Reducing the nearest proximity of approach of the armature 28 to the magnet 12 serves to reduce the maximum attractive force, and vice versa.

It will be evident that for any given amount of attractive force, an increase in the depth of penetration of the armature into the groove 18 increases the effectiveness of the retainer in its opposition to movement of the door from its retained position, and vice versa. On the other hand, for any given amount of penetration of the armature 28 into the groove 18, an increase in the attractive force increases the effectiveness of the retainer in its opposition to movement of the door from its retained position.

From the foregoing it is plain that the screws 20 control the effectiveness or efficiency of the retainer in two ways, namely, (a) by limiting the penetration of the armature 28 into the groove 18, and (b) by limiting the force of attraction. In the instant case, the degree of control effected by adjustment of the screws 20 is enhanced by the fact that adjustment of the screws 20 so as to reduce maximum armature penetration serves at the same time to reduce the maximum attractive force with both such reductions serving to reduce the effectiveness of the retainer in opposing movement of the door from its retained position. The converse is manifestly true for enhancing the effectiveness of the retainer.

Figure 4:
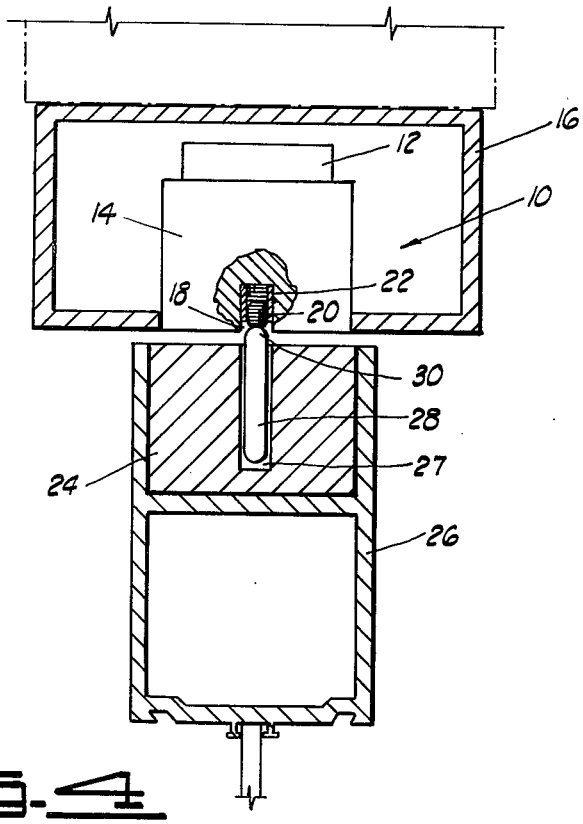
FIG. 4 is an end sectional view of the retainer.

In FIG. 4 an end sectional view of the door frame 16 and door 26 is shown. In this view a cut-away section of the magnet housing 14 is shown to illustrate the adjustable screw 20 in the metal spacer 22. Also shown is the bar 28 with the top portion 30 of the bar 28 received in the groove 18 and positioned against one end of the screws 20. Also seen in this view is the elongated channel 27 with the metal bar 28 slidably received therein. When the force of the magnetic attraction between the bar 28 and the magnet 12 is overcome and the resistance of the sides of the groove 18 against the sides of the top portion 30 of the bar 28 is overcome, the door 26 is allowed to open the door frame 16. When the door 26 is opened, the bar 28 drops downwardly into the channel 27 and rests therein until the door 26 is closed and the channel 27 is indexed with the groove 18 and the bar 28 is again magnetically attracted to the magnet 12 and is urged upwardly with the top portion 30 received in the groove 18. Should it no longer be necessary to use the retainer 10, the retainer 10 can quickly be de-activated by moving the bar 28 to the left end of the channel 27 as illustrated in FIG. 2.

As mentioned under FIG. 1, the retainer 10 may be mounted in various positions on the door frame 16 and door 26. But, since the bar 28 drops downwardly by gravity into the channel 27 when the retainer 10 is mounted in the top of the door 26, it should be appreciated that when the retainer 10 is mounted on the side of the door frame 16 and door 26, a retaining means would be required for holding the bar 28 in the channel 27 when the door 26 is opened. The retaining means could be a coil spring or the like for biasing the bar 28 back into the channel 27.

Figure 5:
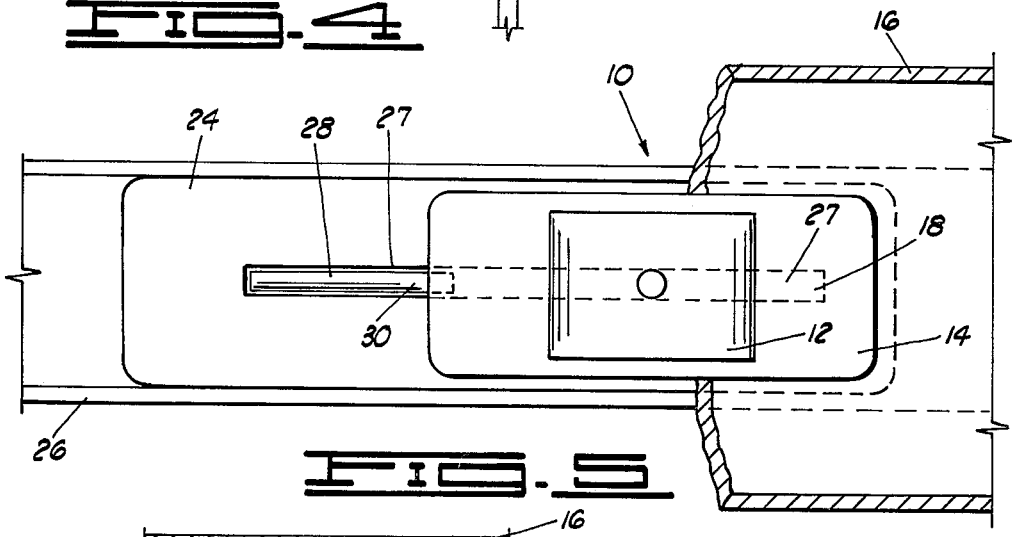
FIG. 5 is a top sectional view of the retainer.

In FIG. 5 a top sectional view of the door frame 16 and door 26 is shown. In this view the elongated channel 27 may be seen more clearly with the retainer 10 in a deactivated position and the bar 28 moved to the left end of the channel 27.

FIG. 5, like FIG. 4, shows that the width of the magnet 12 is substantially greater than the widths of the groove 18 and the armature 28, which enables an advantageous effect as will be readily understood.

Such advantageous effect resides in the fact that the armature 28 is subjected to a magnetic lifting force prior to the door swinging sufficiently for the armature 28 to be in registry (directly below) the groove 18, whereby the armature may commence or conclude its upward movement prior to the occurrence of registry necessary for entry of the armature 28 into the groove 18. Such function enables the armature 28 to enter the groove 18 when their relative velocity might not otherwise allow sufficient time for such entry. It is also evident that such arrangement allows considerable latitude in the relative vertical spacing of the mountings of the magnet 12 and of the armature 28. Also, after installation of the retainer, considerable sagging of the door can occur without significantly effecting operation of the retainer.

Figure 6:
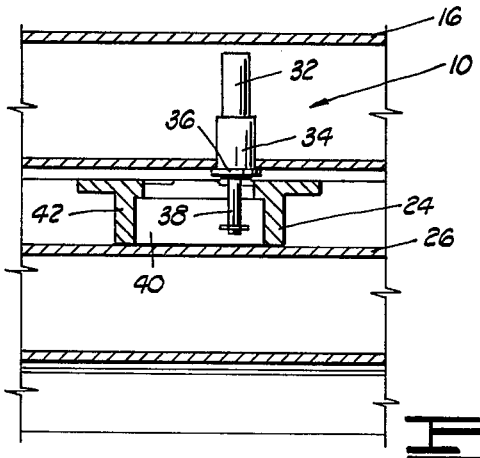
FIG. 6 is an alternate embodiment of the retainer.

In FIG. 6 an alternate embodiment of the retainer 10 is illustrated having cylindrical magnet 32 mounted in an annular-shaped magnet housing 34. The housing 34 includes a flange 36 for holding the magnet 32 and housing 34 against the top of the door frame 16. A generally cylindrical metal retainer bar or armature 38 is slidably received in a channel 40 in a retainer bar housing 42 mounted in the top of the door 26. In this embodiment, the magnet 32 is adjustable in the magnet housing 34 for defining jointly with the latter a downwardly opening recess 44 shown inlarged in FIG. 6A. The recess 46 is the counterpart of the groove 18 in the previously described embodiment, and such recess 46 may be considered to be a cylindrical groove in the housing 42.

Figure 6A:
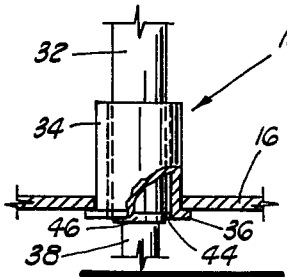
FIG. 6A is an enlarged view of a portion of the retainer shown in FIG. 6.

In FIG. 6A a radially enlarged top portion 46 of the bar 38 is shown received inside the recess or groove 44 and abutting one end of the magnet 32. In this position the door 26 is retained in a closed position in the door frame 16. To open the door 26 the magnetic force between the bar 38 and the magnet 32 must be overcome along with the resistance of the portion of the housing 34 defining the sides of the recess or groove 44 against the radially enlarged or flanged top portion 46 of the bar or armature 38. When this force is overcome, the door 26 opens in the door frame 16. As it can be appreciated, by moving the adjustable magnet 32 upwardly or downwardly in the housing 34, the depth of the recess or groove 44 is adjusted accordingly and the force required to open the door 26 is also adjusted.

The magnet 32 and its housing 34 constitute what may be termed a magnetic unit, with the armature 38 and its housing 42 constituting an armature unit. Such units jointly making up a magnetic door retainer assembly suitable for marketing for mounting on a door and its frame as described.

Similarly, the components of the previously described embodiment mounted in the door frame 16 such as the magnet 12, its housing 14, the spacers 22 and the screws 20 constitute a magnetic unit, with the armature 38 and its housing 24 constituting an armature unit. Such units can be marketed as a door retainer assembly for mounting as described and shown.

Changes may be made in the construction and arrangement of the parts or elements of the embodiments as described herein without departing from the spirit or scope of the invention defined in the following claims.

I claim:

1. In a magnetic door retainer assembly of the type that includes a magnetic unit and an armature unit, such units being adapted for mounting in a door frame and in a door in an orientation relative to each other, when in coacting registry, that is normal to the direction of their relative movement from registry on door opening movement, the improvement comprising said magnetic unit including a magnet and having a recess therein that opens toward the armature unit when the units are in registry, said armature unit including an armature mounted for movement therein between retracted and partially extended positions, with said armature being magentically urged toward the magnet and partially received in the recess when the units are in registry, said magnet and said armature constituting elements of a magnetic circuit when the armature is partially received in the recess, and means carried by the magnetic unit for adjustably predetermining the minimum value of the reluctance of said magnetic circuit.

2. The combination of claim 1, wherein said last means comprises means for limiting the approach of the armature to the magnet.

3. The combination of claim 1, wherein said means also limits the extent of penetration of the armature into the recess.

4. The combination of claim 1, wherein the recess is elongated; with the direction of such elongation, the direction of relative movement of the units, and the direction of movement of the armature when the units are in registry all being substantially mutually perpendicular to each other; and said armature being elongated in a direction parallel to the direction of elongation of the recess when the units are in registry.

5. In a magnetic door retainer assembly of the type that includes a magnetic unit and an armature unit mountable on a door frame and a door, the improvement comprising said magnetic unit including a magnet and having a recess therein, said armature unit being provided with an armature that is slidably movable therein between a retracted position and an extended position such that the armature projects from the armature unit, said units normally being in registry relative to each other such that the recess opens toward the armature unit and the armature is magnetically attracted from its retracted position and projects into the recess, said armature being elongated in a direction normal to its direction of movement between its retracted and extended positions, said magnet being in alignment with the direction of movement of the armature, said recess being elongated in parallelism to the elongation of the armature and having a configuration generally conformable to that of the armature projecting thereinto, said recess having a limited depth such that the extent of projection of the armature thereinto is sufficient to oppose but not to prevent the units from being movable relative to each other in a direction perpendicular to both the direction of movement of the armature and the direction of elongation of the latter and including threadingly adjustable stop means carried by the magnetic unit for limiting the projection of the armature into the recess.

6. The combination of claim 5, including means for disabling the door retainer assembly, said means comprising the armature unit being provided with an armature storage recess that is laterally displaced from said direction of movement of the armature, with said armature being selectively positionable in said storage recess.

7. The combination of claim 5, wherein said magnetic unit is mounted on a door frame and said armature unit is mounted on a door so that the units are in registry when the door is closed, with said units being so oriented that relative movement of the units on opening movement of the door is in a direction perpendicular to the direction of movement of the armature as well as being perpendicular to the direction of elongation of the latter.

8. The combination of claim 7, wherein said magnet has a substantially greater width than the elongated armature.

9. In a magnetic door retainer assembly of the type that includes a magnetic unit and an armature unit, such units being adapted for mounting in a door frame and in a door in an orientation relative to each other, when in coacting registry, that is normal to the direction of their relative movement from registry on door opening movement, the improvement comprising said magnetic unit including a magnet and having a recess therein that opens toward the armature unit when the units are in registry, said armature unit including an armature mounted for movement therein between retracted and partially extended positions, with said armature being magnetically urged toward the magnet and partially received in the recess when the units are in registry, said magnet and said armature constituting elements of a magnetic circuit when the armature is partially received in the recess, and threadingly adjustable stop means carried by the magnetic unit for limiting the extent of armature received in the recess when the units are in registry.

* * * * *